US007093713B2

(12) United States Patent
Sutherland

(10) Patent No.: US 7,093,713 B2
(45) Date of Patent: Aug. 22, 2006

(54) FULLY ENCLOSED PACK WITH INTERLOCKING SEPARATOR PAD AND DISPENSER

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 390 days.

(21) Appl. No.: 10/770,301

(22) Filed: Jan. 30, 2004

(65) Prior Publication Data

US 2005/0167290 A1 Aug. 4, 2005

(51) Int. Cl.
*B65D 75/00* (2006.01)

(52) U.S. Cl. ..... 206/430; 206/427

(58) Field of Classification Search ..... 206/139, 206/160, 162, 170, 193, 427, 430, 821; 229/5.5, 229/120.32, 240–242, 198.2
See application file for complete search history.

(56) References Cited

U.S. PATENT DOCUMENTS

| | | | | |
|---|---|---|---|---|
| 1,896,326 A | | 2/1933 | Northway-Ley | |
| 1,898,646 A | | 2/1933 | Taylor | |
| 2,875,942 A | | 3/1959 | Wilson | |
| 3,822,785 A | | 7/1974 | Getz et al. | |
| 4,120,443 A | | 10/1978 | Gardner et al. | |
| 4,577,799 A | * | 3/1986 | Oliff | 206/427 |
| 5,415,344 A | | 5/1995 | Harrelson | |
| 5,427,242 A | * | 6/1995 | Oliff et al. | 206/430 |
| 5,518,111 A | * | 5/1996 | Stout | 206/160 |
| 5,669,500 A | * | 9/1997 | Sutherland | 206/427 |
| 5,682,984 A | | 11/1997 | Hoell et al. | |
| 5,772,030 A | | 6/1998 | Baxter | |
| 5,826,783 A | * | 10/1998 | Stout | 206/427 |
| 5,868,252 A | | 2/1999 | Oliff | |
| 5,938,109 A | | 8/1999 | Sainz et al. | |
| 6,991,107 B1 | * | 1/2006 | Harrelson | 206/427 |

FOREIGN PATENT DOCUMENTS

| | | |
|---|---|---|
| CH | 263456 | 8/1949 |
| DE | 88 14 144.6 | 1/1989 |

(Continued)

*Primary Examiner*—Luan K. Bui
(74) *Attorney, Agent, or Firm*—Womble Carlyle Sandridge & Rice, PLLC

(57) ABSTRACT

A carton is provided for carrying articles or containers in two layers with three rows of containers in each layer. The carton can have a dispenser flap in one side panel which can be opened for dispensing containers when the carton is placed on the end adjacent to the dispenser opening. The two layers of containers are kept separate during the dispensing by an interlocking separator pad that is interlocked to the side end flaps on one end of the carton by punch locks going through the primary female openings of the leading flap attached to the separator pad. A secondary locking system is provided by a swing lock in each side end flap on the interlocking end of the carton which has a secondary male lock attached to it that is inserted into a secondary female opening in the separator pad. Each secondary male lock may have a locking slot that engages a locking edge of the secondary female opening. A secondary locking system can be provided on the other end of the carton by side end flaps which have a swing lock to which is attached a secondary male lock having a locking slot that engages a locking edge of a secondary female opening in the separator pad. These locking systems hold the interlocking separator pad in proper position as containers are removed from the carton.

38 Claims, 6 Drawing Sheets

FOREIGN PATENT DOCUMENTS

| | | |
|---|---|---|
| DE | G 91 11 941.3 | 2/1992 |
| FR | 1.427.897 | 4/1966 |
| FR | 1.489.087 | 7/1967 |
| FR | 1.497.652 | 10/1967 |
| FR | 2.223.985 | 10/1974 |
| GB | 434145 | 8/1935 |
| GB | 2 198 709 A | 6/1988 |
| GB | 2 323 352 | 9/1998 |
| JP | 7-125745 | 5/1995 |
| JP | 9-142449 | 6/1997 |
| JP | 11-130049 | 5/1999 |
| JP | 2000-85754 | 3/2000 |
| WO | WO 96/29261 | 9/1996 |
| WO | WO 02/030764 A3 | 4/2002 |

* cited by examiner

FULLY ENCLOSED PACK WITH INTERLOCKING SEPARATOR PAD AND DISPENSER

BACKGROUND OF THE INVENTION

1. Field of the Invention

The present invention relates generally to a carton for carrying cylindrical containers or other types of articles in two layers, with each layer having three rows of containers. An interlocking separator pad is provided which has female openings for receiving a punch lock and a secondary male lock attached to the side end flaps on the interlocking end of the carton. This carton may have a dispenser in a side panel to permit easy access and removal of the containers in the carton.

2. Background of the Invention

Fully enclosed cartons that are capable of carrying cans have been used in the past that have a feature for dispensing the cans one at a time. Many of these dispensers do not work in a satisfactory fashion when the cans are carried in two layers. It is desirable to carry cans of certain products in two layers, especially when the can size is small. It would be desirable to have a dispenser that would permit the dispensing of cans from each layer in a carton that contains two layers of cans. It would be desirable to have a divider or separator pad separating the two layers of cans in order for the dispenser in the carton to work properly. Otherwise, the cans in one layer could interfere with the dispensing of cans in the other layer. It would also be desirable to have a divider, or separator, pad that would remain in place during the dispensing of all cans in the carton. It would also be desirable to have a divider, or separator, pad that would work with the dispenser in the side panel of the carton.

SUMMARY OF THE INVENTION

Briefly described, the present invention relates to a fully enclosed carton that is capable of carrying two layers of cans or other articles which has an interlocking separator, or divider pad, separating the two layers of cans or other articles. This carton has a bottom panel, top panel and foldably attached side panels. Preferably each end of the carton is closed by a pair of side end flaps to which a top end flap and bottom end flap are secured, preferably by glue. At least one end of the carton is an interlocking end. Each side end flap on the interlocking end of the carton has a recessed section in the end which contains a punch lock with two shoulders and a swing lock which are foldably attached to the side end flap. The swing lock is located between the punch lock and the top panel of the carton and the swing lock has a secondary male lock that is attached by a fold line which is perpendicular to the fold lines by which the swing lock and the punch lock are attached to the side end flap.

An interlocking separator pad is provided which has at least one interlocking end located adjacent to the interlocking end of the carton. This pad is located between two layers of containers. The interlocking end of the pad has a leading flap which extends towards the bottom or panel top of the carton. The interlocking pad has two female openings adjacent to the interlocking end which receive a secondary male lock attached to the swing lock when the swing lock is folded into position parallel with the side panels of the carton. There are also two female openings in the leading flap into which punch locks are pushed into position with the shoulders of each punch lock holding the lock in the locked position against the locking edges of the female opening.

The separator pad can have an interlocking end on each end with each end of the carton also being an interlocking end.

If only one end of the carton is interlocked with the leading flap of the separator pad, the other end of the carton can have side end flaps that have a recessed section with a swing lock to which is attached a secondary male lock that extends into a female aperture adjacent the other end of the separator pad. The secondary male locks on each end of the carton hold the separator pad in position between the two layers of containers even when the containers are being taken from the carton through a dispenser opening. The secondary male locks on the side end flaps may have a slot which overlaps a locking edge of the female opening in the pad holding the pad securely in position.

Preferably the containers in this carton are arranged in three rows with the locks and female openings on each end of the carton being arranged between the first and second row of containers and between the second and third row of containers.

Both ends of the carton are preferably closed by folding the side end flaps and locking them with the separator pad and leading flap and then folding the bottom end flap up and gluing it to the side end flaps and folding the top end flap down and gluing it to the side end flaps and overlapping the bottom end flap.

This carton preferably has a dispenser flap which when opened forms a dispenser opening for the removal of containers from each layer. The dispenser flap is formed by a bottom tear line in the side panel which is basically parallel to the end of the carton and having a parallel top tear line. Preferably both the top and bottom tear lines extend into the adjoining bottom and top panel and are interconnected.

This carton is placed on the end adjacent dispenser and the dispenser flap tom opened for dispensing containers. The bottom tear line needs to be far enough from the end of the carton to prevent containers from rolling out but also permitting easy access to remove the containers. The bottom and top tear lines are spaced at a distance that is approximately equal to the diameter of a container.

The bottom and top tear lines for forming the dispenser flap are preferably connected to one or more finger flaps in the middle to facilitate removing the dispenser flap in two sections. There may be a tear line in the bottom panel between the bottom tear line and the end and a tear line in the top panel between the bottom tear and the end so that the ledge formed between the bottom tear line and the end of the carton can be moved forward to permit the easy removal of containers in the dispenser opening. A container can be removed from the carton by a person grasping the ends of the container through the dispenser opening that extends into the bottom panel and top panel and pulling the container out of the dispenser opening.

This carton is preferably constructed by gluing the end flaps together, but can be constructed by taping, stapling and the like.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention is primarily for use with articles or cans of the type used to contain meat products, vegetables, fish and soup. The carton of this invention is primarily useful for cans that are stacked in the carton in two layers with three rows in each layer. These cans typically only have height of two or three inches and are stacked in a carton in two layers of twelve cans in each layer.

Figure 1:
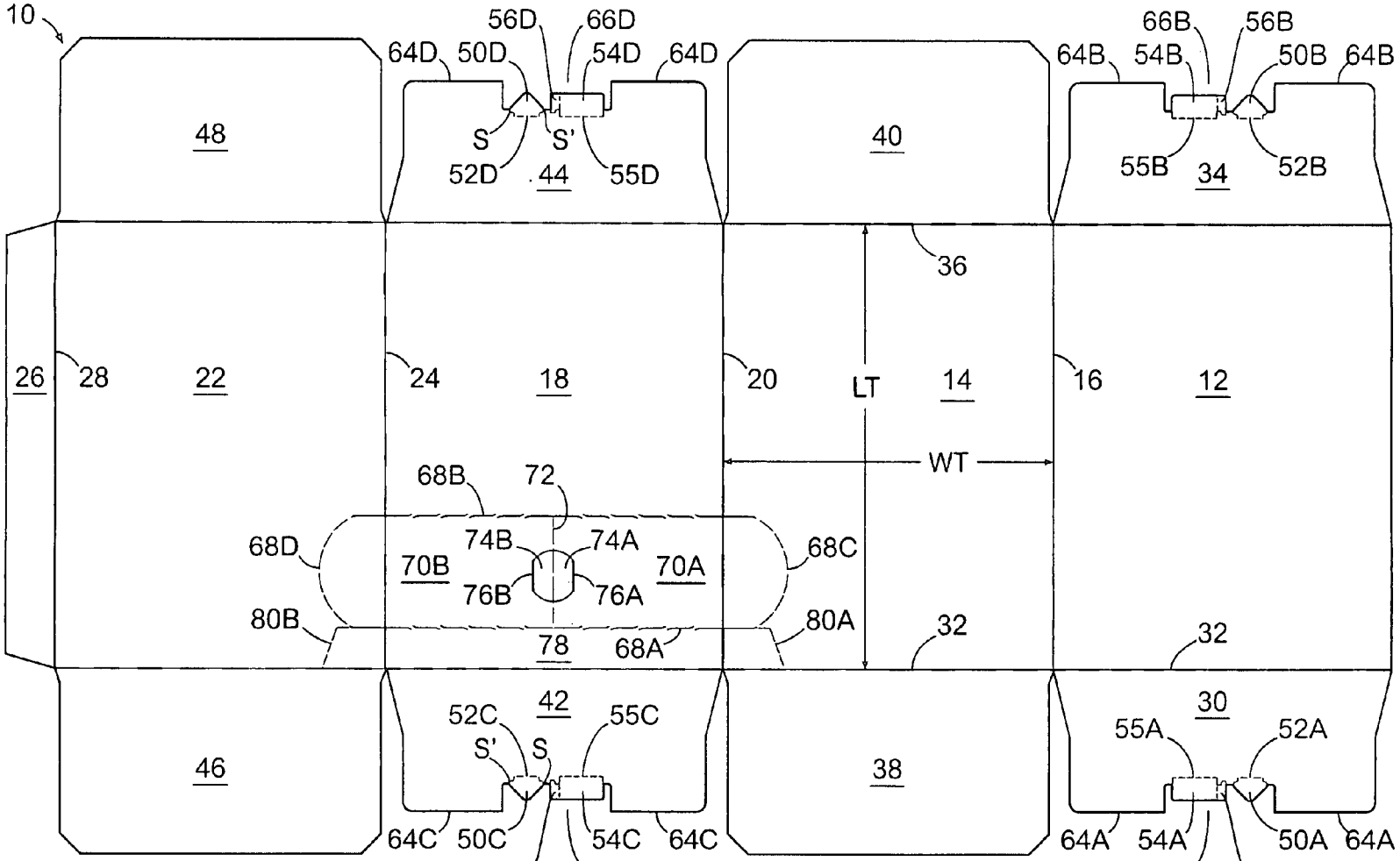
FIG. 1 is a plan view of the blank for forming a carton of this invention.
Figure 2:
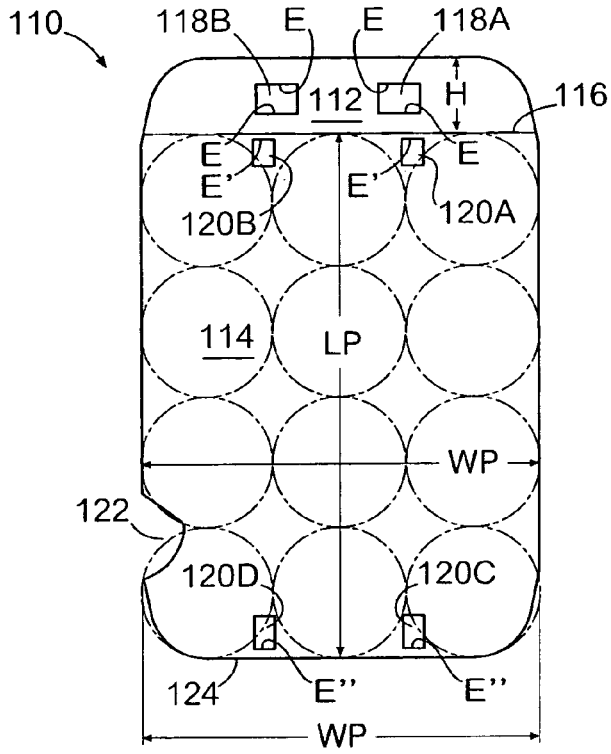
FIG. 2 is a plan view of an interlocking separator pad for separating two layers of containers in the carton formed by the blank of FIG. 1.

As illustrated in FIG. 1, the blank 10 for forming the carton of this invention is formed from a foldable sheet of material, such as paperboard. The blank 110 for forming the interlocking separator pad as shown in FIG. 2 is also formed from a foldable sheet of material, such as paperboard.

The blank 10 for forming the carton of this invention has a side panel 12 that is attached to top panel 14 by fold line 16, and in turn connected to opposite side panel 18 by fold line 20, and to bottom panel 22 by fold line 24, and finally to glue flap 26 by fold line 28. Side panel 12 is foldably attached to side end flap 30 by fold line 32 and to side end flap 34 by fold line 36. Top panel 14 is foldably attached to top end flap 38 by fold line 32 and to top end flap 40 by fold line 36. Opposite side panel 18 is foldably attached to side end flap 42 by fold line 32 and to side end 44 by fold line 36. Bottom panel 22 is foldably attached to bottom end flap 46 by fold line 32 and foldably attached to bottom end flap 48 by fold line 36.

Side end flaps 30, 34, 42 and 44 have primary punch locks 50A–D formed in a recessed section 66A–D on the remote end of the flap. It should be understood that punch locks only need be formed on one interlocking end of the carton. It is preferred to have a punch lock in each side end flap. In some cartons a single punch lock may be sufficient on the interlocking end of the carton. Each punch lock as illustrated in the enlarged view of side end flap 30 shown in FIG. 3 by 50A has a bottom locking shoulder S and a top locking shoulder S' and cut lines C for forming the base of the punch lock and the shoulders of the punch lock. These punch locks 50A–D are attached to the side end flaps by fold lines 52A–D. The same recessed section 66A–D is preferably provided on each side end flap on the interlocking end of the carton. This recessed section 66A–D also has a swing lock 54A–D which is attached to the respective side end flap 30, 34, 42 and 44 by lock hinge 55A–D respectively. A secondary male lock 56A–D is attached to each swing lock 54A–D by lock hinge 60A–D as best illustrated in the enlarged view of the recessed section on side end flap 30 in FIG. 3. Each secondary male lock can have a locking slot 58A–D, which is illustrated by 58A in the enlarged view shown in FIG. 3.

Figure 8:
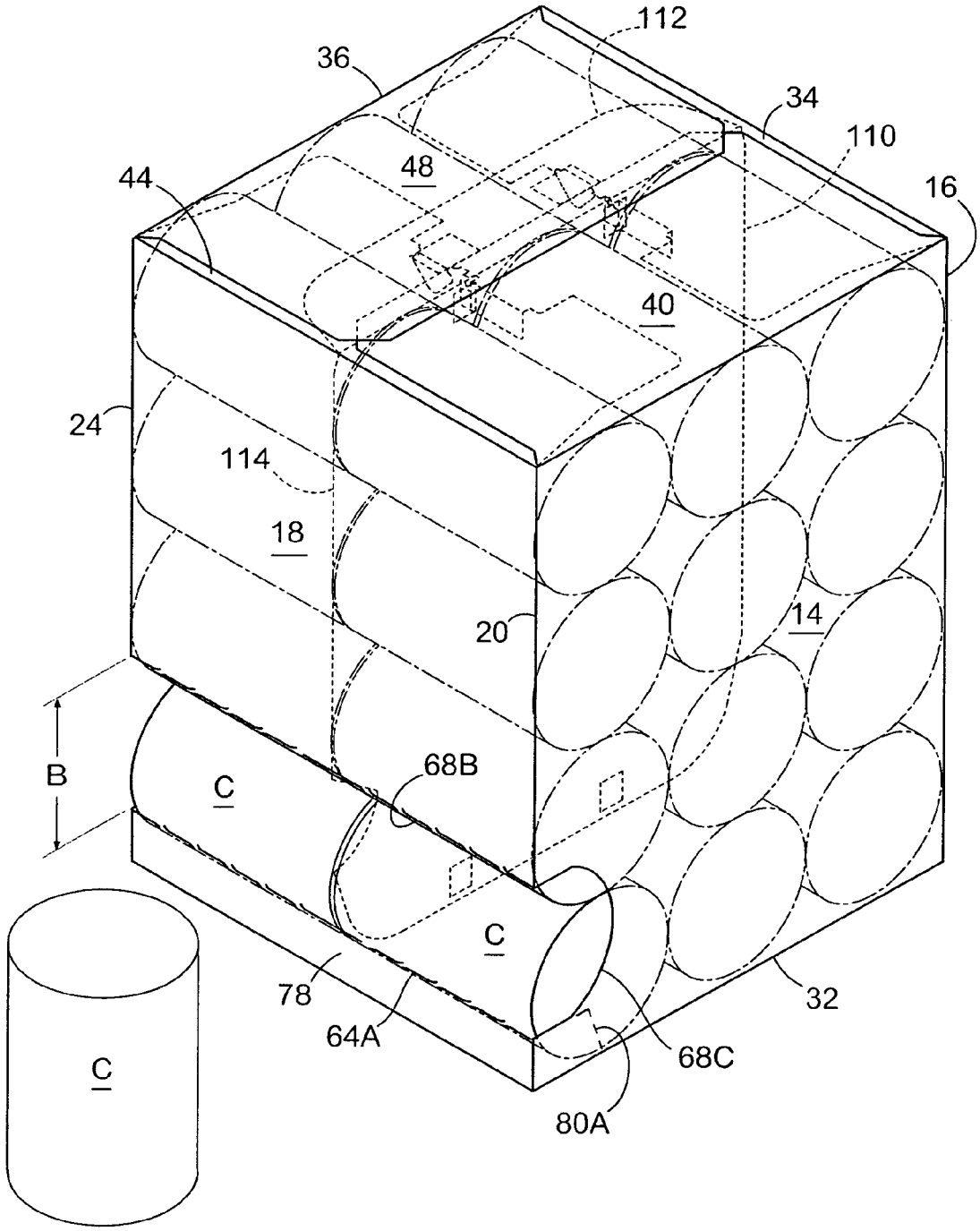
FIG. 8 is a perspective view of a carton with the separator pad placed in the carton fully loaded with cans with the dispenser flaps having been removed exposing a dispenser opening for the removal of cans.

A dispenser can be provided in this embodiment of the carton to permit the convenient removal of cans from the carton. For example, a dispenser opening B as illustrated in FIG. 8 can be formed in side panel 18 by providing bottom tear line 68A and top tear line 68B which can extend into the top panel and be interconnected by interconnecting tear line 68C. Bottom tear line 68A and top tear line 68B can extend into the bottom panel 22 and be interconnected by interconnecting tear line 68D. While a single dispenser flap can be formed, for ease of opening it is preferred to have two dispenser flaps as shown by 70A and 70B. Middle tear line 72 can be provided between bottom tear line 68A and top tear line 68B. Finger flaps 74A and 74B may be provided along middle tear line 72 to commence opening of dispenser flaps 70A and 70B. Finger flap 74A is foldably attached to dispenser flap 70A by fold line 76A and finger flap 74B is foldably attached to dispenser flap 70B by fold line 76B. Tear lines 80A and 80B provided in top panel 14 and bottom panel 22 connect bottom tear line 68A to fold line 32.

Figure 7:
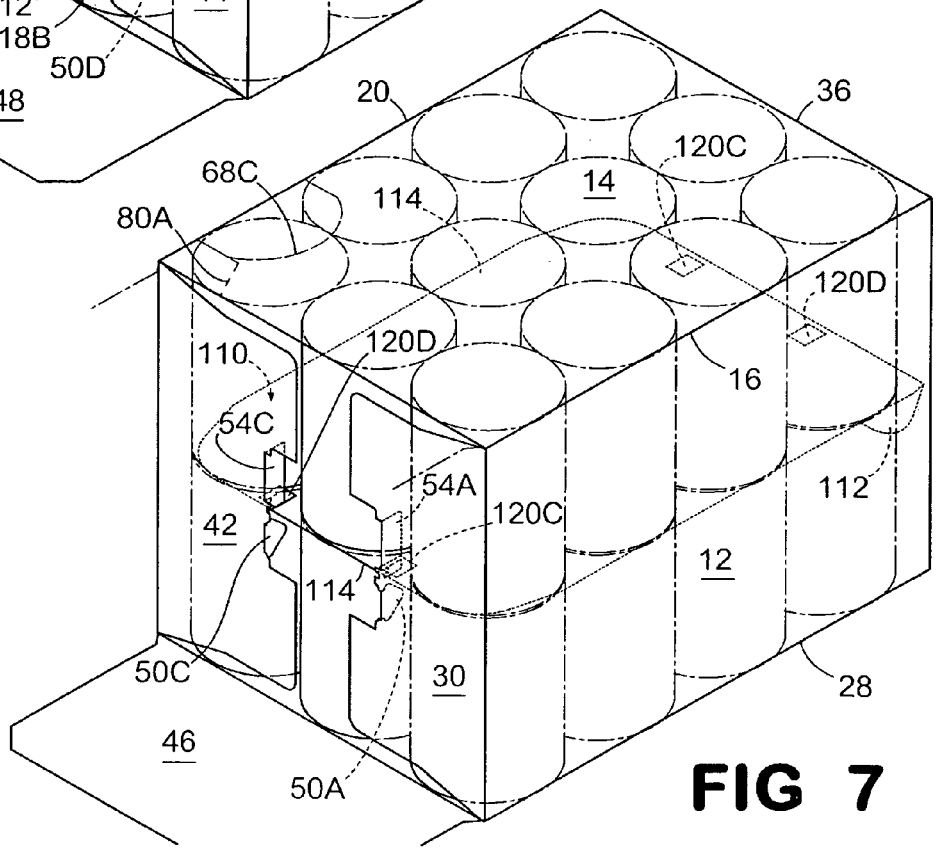
FIG. 7 is a perspective end view of the other end of the carton showing the separator pad locked by the secondary male locks on swing locks attached to the side end locks with the secondary male locks locked into the secondary female openings in the pad.

A blank 110 for the interlocking separator is shown in FIG. 2. The blank 110 has leading flap 112 attached to separator pad 114 by fold line 116. Leading flap 112 can have two primary female openings 118A and 118B, each of which has two locking edges E. This end of the separator pad 114 has two secondary female openings 120A and 120B, each of which has a locking edge E' which is adjacent to fold line 116. The other end of separator pad 114 can be locked to the carton by one or two secondary female openings 120C and 120D, each of which has a locking edge E' adjacent to the end 124 of separator pad 114. Two secondary female openings 120C and 120D are preferred. Separator pad 114 has cut out 122 which provides easy access to the containers in each layer through the dispenser opening B as shown in FIG. 7.

The length LP of the separator pad 114 is approximately the same as or slightly less than the length LT of top panel 14 of the carton. Width WP of the separator pad 114 has to be slightly less than width WT of the top panel 14. The height H of the leading flap 112 must be less than the height of the containers to be contained in the carton. Flap 112 only need to have height H sufficient for the interlocking with the side ends flap on the interlocking end of the carton.

Figure 3:
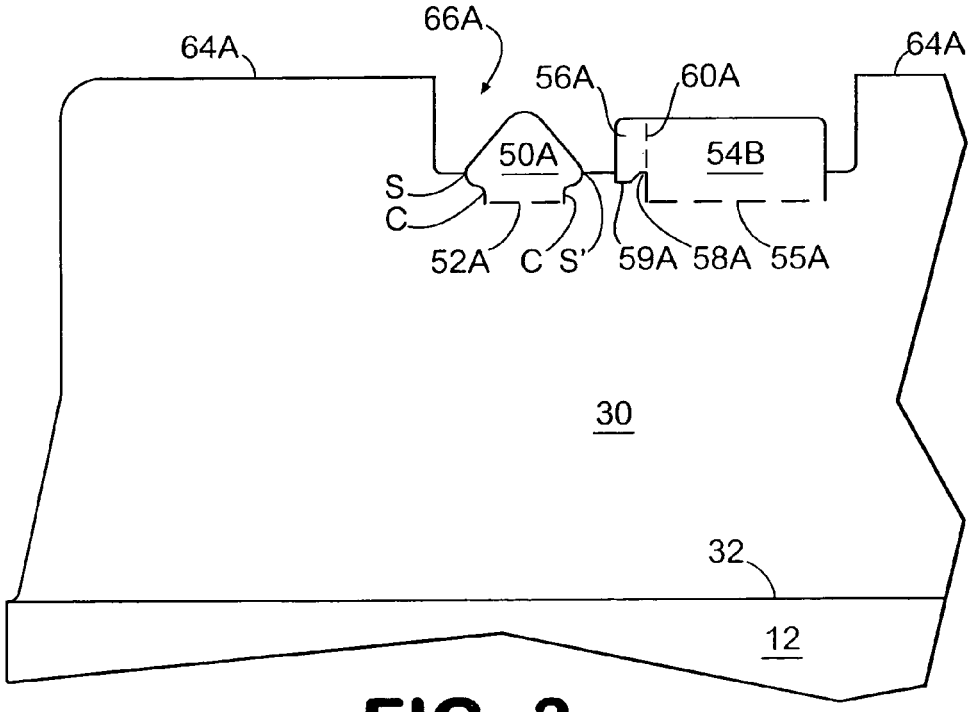
FIG. 3 is an enlarged view of a punch lock and swing lock with a foldably attached secondary male lock on side end flap 30 as shown in FIG. 1.
Figure 4:
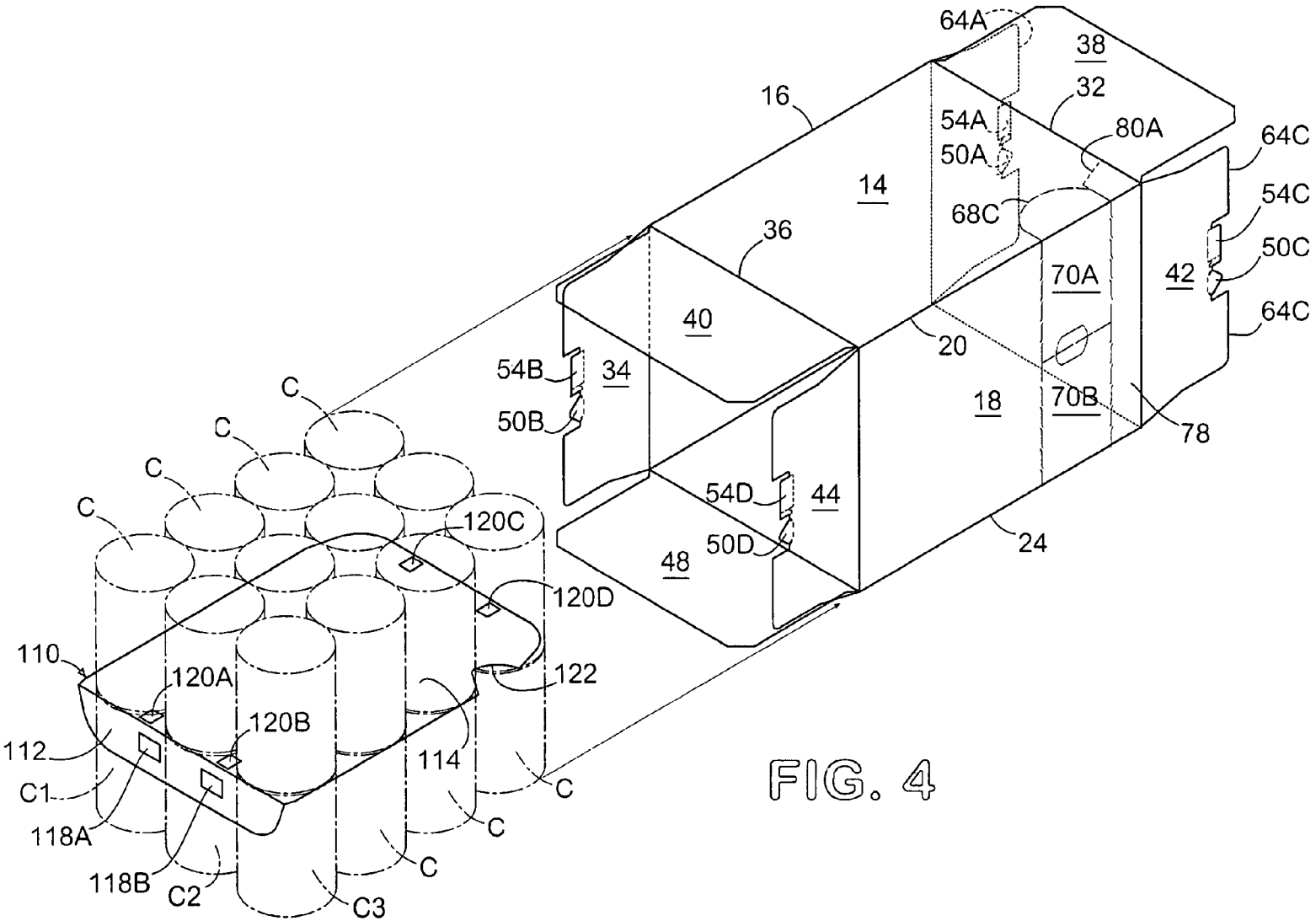
FIG. 4 is a perspective end view of a carton formed from the blank of FIG. 1 with a separator pad in position for insertion into the carton with three rows of cans in each layer. The leading flap of the separator pad has been folded down in preparation for locking this end of the carton.
Figure 5:
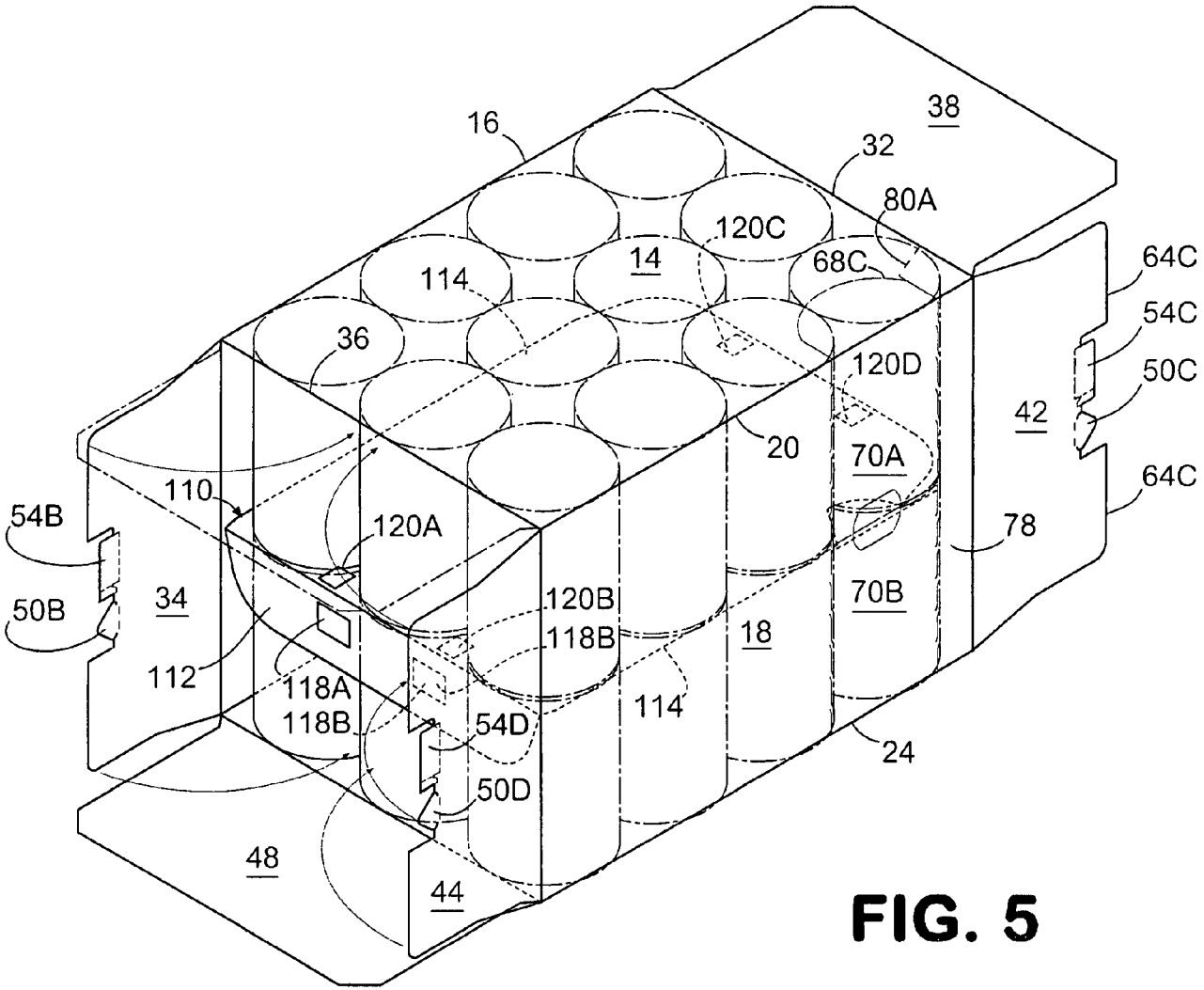
FIG. 5 is a perspective end view of the carton of FIG. 4 with cans in the carton in two layers illustrating the method of interlocking the separator pad with the a side end flaps.

Blank 10 of this embodiment is formed into a carton sleeve by gluing glue flap 26 to side panel 12. Separator pad 114 is placed between two layers of containers (e.g., cans) and inserted into the carton sleeve as shown in FIG. 4. The cans represented by C1–C3 constitute three rows of cans in one layer. Cylindrical containers are usually stacked on their ends with their axes perpendicular to the separator pad 114. Alternatively, the bottom layer of containers with the separator pad 114 on top can be inserted into the carton sleeve. The top layer of containers can then be inserted on top of separator pad 114. The leading flap 112 can be folded up towards the top panel 14 or down towards the bottom panel 22. Side end flaps 34 and 44 can then be closed with punch locks 50B and 50D with the shoulders S and S' of the punch lock, as best shown in enlarged view FIG. 3, being engaged with locking edges E of primary female openings 118A and 118B. These punch locks 50B and 50D on the interlocking end of the carton hold the separator pad 114 tightly to side end flaps 34 and 44 and also prevents this end of the separator pad 114 from moving sideways in the carton as containers are being removed through the dispenser opening B as shown in FIG. 8.

Figure 6:
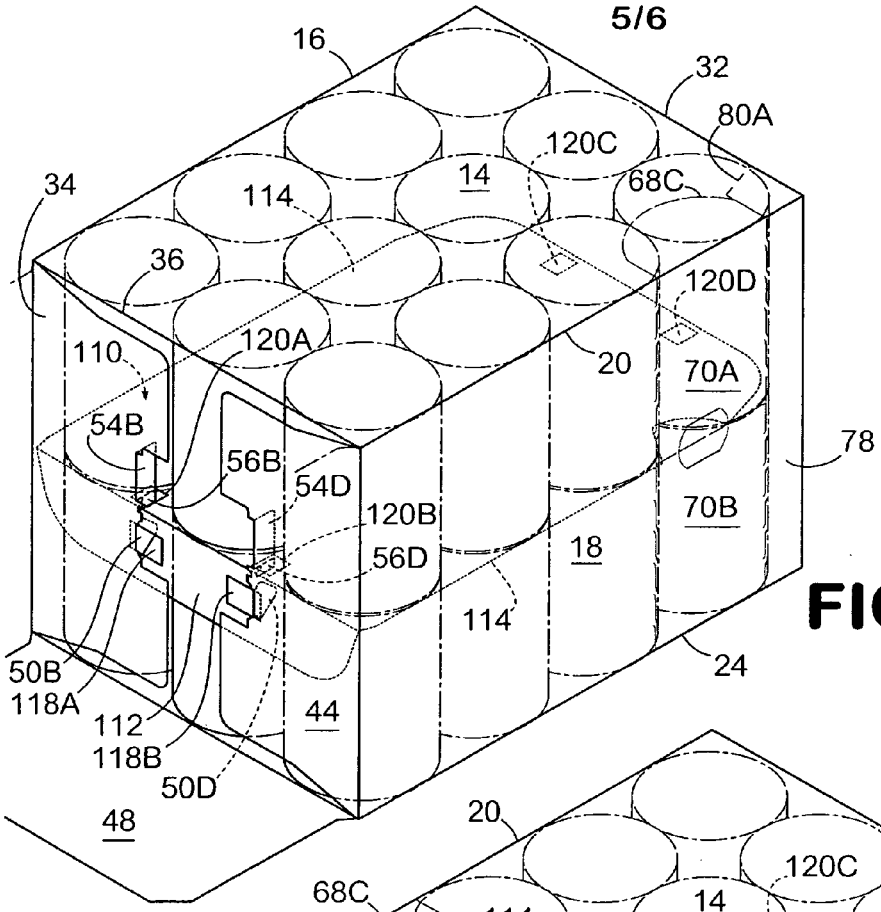
FIG. 6 is a perspective end view of the carton shown in FIG. 5 with the side end flaps on one end of the carton in which the punch locks are locked in the primary female openings in the leading flap and the swing locks pushed into the carton with the secondary male locks locked in the secondary female openings in the interlocking separator pad.

As side end flaps 34 and 44 are closed, swing locks 54B and 54D are pushed inwardly where the respective secondary male locks 56B and 56D are pushed into the secondary female openings 120A and 120B as illustrated in FIG. 6. The swing locks 54B and 54D are located between the punch locks 50B and 50D and the top panel 14 with the secondary male locks 56B and 56D being adjacent to top locking shoulder S' of the respective punch locks 50B and 50D thus locking this end of the separator pad 114 between the punch locks and secondary male locks. The locking slots 58B and 58D are locked over the locking edge E' of secondary female openings 120A and 120B as shown in FIGS. 2 and 3. The locking slot is best shown in the enlarged view of FIG. 3 as 58A. These locking slots 58B and 58D hold the separator pad 114 tightly against side end flaps 34 and 44. These secondary male locks 56B and 56D prevent the shifting of the separator pad 114 from side end flaps 34 and 44 during the removal of cans from the dispenser opening B as shown in FIG. 8. This prevents the shifting of cans during the removal of cans either from dispenser opening B or some other type of opening in the carton.

The bottom end flap 48 can be folded up and glued to side end flaps 34 and 44 as shown in FIG. 6. Top end flap 40 can be folded down and glued to side end flaps 34 and 44, thus sealing and closing this end of the carton. Top end flap 40 can overlap and be glued to bottom end flap 48. The other end of the carton is closed by folding side end flaps 30 and 42 and pushing swing locks 54A and 54C inwardly so that the secondary male locks 56A and 56C are locked in secondary female openings 120C and D, as shown in FIG. 7. The locking slots 58A and 58C of each secondary male lock engages the locking edge E", thus holding separator pad 114 tightly against the side end flaps 30 and 42 and preventing the separator pad 114 from shifting when a container is removed from the dispenser opening B. In this embodiment, the punch locks 50A and 50C are not used as there is no leading flap attached to the separator pad 114 on this end of the carton. A leading flap like leading flap 112 can be placed on this end of the separator pad and interlocked with this end of the carton in the same way that leading flap 112 is interlocked. The bottom end flap 46 can be folded up with the top end flap 38 folded down and glued to the side ends flaps 30 and 42 as with the other end of the carton.

The dispenser opening B can be made by placing the carton on its end as illustrated in FIG. 8 and pushing in finger flaps 74A and 74B and tearing open dispenser flaps 70A and 70B. If necessary, tear lines 80A and 80B can be torn open and dispenser ledge 78 moved forward to facilitate the removal of containers through dispenser opening B. The distance between bottom tear line 68A and fold line 32 should be less than the diameter of a can so that it prevents cans from automatically rolling out of the carton when dispenser opening B is open, but not so high as to prevent the removal of a can immediately adjacent through this end of the carton. Preferably, the distance between bottom tear line 68A and fold line 32 is approximately one inch for many sizes of cans.

It will be appreciated that primary female openings 118A and 118B are located between container row C1 and C2 and between container row C2 and C3 to facilitate the inserting of punch locks 50B and 50D. This is also important in respect to folding swing lock 54B and 54D so that secondary male locks 56B and 56D will be interlocked with secondary female openings 120A and 120B.

It should be appreciated that a leading flap, like leading flap 112, can be placed on the other end of the separator pad 114 for interlocking both ends of the carton to the leading flaps of the separator pad.

The punch locks 50A and 50D hold the separator pad 114 tightly against the side end flaps 34 and 44. The secondary male locks 56A–D prevent the separator pad 114 from moving side to side during the removal of cans, which may interfere with their removal, as one can ascertain from FIG. 8. In other words, the secondary male locks 56A–D prevent the separator pad 114 from moving back and forth between the top panel 14 and bottom panel 22 as cans are removed from one or both layers of cans.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claimed:

1. An article carrying carton with two ends loaded with a plurality of articles comprising:

(a) said carton having a bottom panel, top panel and foldably attached adjoining side panels with at least one end being an interlocking end which is closed by a top end flap foldably attached to the top panel, a bottom end flap foldably attached to the bottom panel and a side end flap which is foldably attached to each side panel, with at least one side end flap having an end remote from the side panel to which side end flap is attached, with said side end flap having a recessed section in said remote end in which a punch lock with two shoulders and a swing lock are located, with each lock attached to the side end flap by a fold line at least substantially parallel to the fold line by which the side end flap is attached to the side panel, said swing lock being located between the punch lock and the top panel of the carton, each said swing lock has a secondary male lock attached by a fold line that is at least substantially perpendicular to the fold line by which the swing lock is attached to the side end flap, said secondary male lock being located adjacent a shoulder of the punch lock, with said end flaps being held together by securing means;

(b) two layers of articles with at least two rows of articles in each layer;

(c) an interlocking separator pad with two ends, of which at least one end is an interlocking end which is located adjacent an interlocking end of the carton, said pad being located between the two layers of articles with each interlocking end of the pad having a foldably attached leading flap which extends toward the bottom panel of the carton, said pad having at least one female opening with at least one locking edge adjacent the interlocking end, said leading flap having at least one female opening with two locking edges;

(d) with at least one punch lock on a side end flap on the interlocking end of the carton projecting through a female opening in the leading flap of the pad with each shoulder on the punch lock being engaged with a locking edge on said opening, with each secondary male lock projecting through a female opening in the pad with each secondary male lock engaging a locking edge of the female opening, thereby interlocking the pad to the side end flaps on the interlocking end of the carton; and (e) means for securing the other end of the carton.

2. The carton loaded with a plurality of articles of claim 1, in which the articles in each layer are arranged in three rows with a female opening in the separator pad and in the leading flap being located between the first and second rows of articles with another female opening in the pad and leading flap being located between the second and third rows of articles.

3. The carton loaded with a plurality of articles of claim 2, in which the articles are cylindrical containers with two ends with an axis extending between the two ends, said axes of the cylindrical containers being perpendicular to the separator pad.

4. The carton loaded with a plurality of articles of claim 1, in which each end of the carton is an interlocking end and each end of the interlocking separator pad is an interlocking end.

5. The carton loaded with a plurality of articles of claim 4, in which the articles are cylindrical containers with two ends with an axis extending through the two ends, said axes of the cylindrical containers being perpendicular to the separator pad.

6. The carton loaded with a plurality of cylindrical containers of claim 3, in which the means for securing the end flaps on the interlocking end of the carton is gluing them together and the other end of the carton is closed by a top end flap foldably attached to the top panel, a bottom end flap foldably to the bottom panel and a side end flap which is foldably attached to each side panel, the securing means being gluing the top end flap, bottom end flap and the side end flaps together.

7. The carton loaded with a plurality of articles of claim 1, in which the other end of the carton is closed by a top end flap foldably attached to the top panel, a bottom end flap foldably attached to the bottom panel and a side end flap foldably attached to each side panel, with each side end flap having an end remote from the side panel to which said side end flap is attached, with each side end flap having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between the top panel of the carton and the secondary male lock, with said separator pad having two female openings adjacent to the other end of the pad, with each female opening having at least one locking edge with each secondary male lock projecting through a female opening in the other end of the pad and engaging a locking edge of the female opening, thereby strengthening the interlocking of the pad to the carton.

8. The carton loaded with a plurality of articles of claim 2, in which the articles are cylindrical containers, each having two ends with an axis extending between the two ends, said axes of the cylindrical containers being perpendicular to the separator pad, in which the other end of the carton is closed by a top end flap foldably attached to the top panel, a bottom end flap foldably attached to the bottom panel and a side end flap foldably attached to each side panel, with each side end flap having an end remote from the side panel to which said side end flap is attached, with each side end having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between the top panel of the carton and the secondary male lock, with said separator pad having two female openings adjacent the other end of the pad with each female opening having at least one locking edge with each secondary male lock projecting through a female opening in the other end of the pad and engaging a locking edge of the female opening, thereby strengthening the interlocking of the pad to the carton.

9. The carton loaded with a plurality of cylindrical containers of claim 8, in which each secondary male lock on each side end flap on each end of the carton has a slot adjacent the fold line by which the secondary male lock is attached to the swing lock which engages the locking edge of a female opening closest to an end of the separator pad.

10. The carton loaded with a plurality of cylindrical containers of claim 9, in which the means for closing each end of the carton is by gluing the top end flap and the bottom end flap to the side end flaps on each end of the carton.

11. The carton loaded with a plurality of cylindrical containers of claim 5, said carton having a dispenser flap which when removed permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

12. The carton loaded with a plurality of cylindrical containers of claim 11, in which said bottom tear line in the side panel of the carton is located from the closest end side flap by a distance which is sufficient to prevent a container adjacent the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

13. The carton loaded with a plurality of cylindrical containers of claim 12, in which the tear lines that extend into the adjoining bottom panel and adjoining top panel of the carton extend into each said panel far enough to permit a person to grasp the adjacent end of a container through the opening formed when the dispenser flap is removed.

14. The carton loaded with a plurality of cylindrical containers of claim 13, in which a tear line interconnects said bottom tear line and top tear line in said side panel of the carton to facilitate opening said dispenser flap.

15. The carton loaded with a plurality of cylindrical containers of claim 14, which has at least one finger flap in the dispenser flap adjacent to the tear line connecting the top and bottom tear lines together in said side panel to facilitate tearing the dispenser flap open.

16. The carton loaded with a plurality of cylindrical containers of claim 15, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

17. The carton loaded with a plurality of cylindrical containers of claim 8, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

18. The carton loaded with a plurality of cylindrical containers of claim 17, in which said bottom tear line in the side panel of the carton is located from the closest side end flap by a distance which is sufficient to prevent a container adjacent the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

19. The carton loaded with a plurality of cylindrical containers of claim 18, in which the tear lines that extend into the adjoining bottom panel and adjoining top panel of the carton extend into each said panel far enough to permit a person to grasp the adjacent end of a container through the opening formed when the dispenser flap is removed.

20. A carton loaded with a plurality of cylindrical containers of claim 19, in which a tear line interconnects said bottom tear line and top tear line in said side panel of the carton to facilitate opening said dispenser flap.

21. The carton loaded with a plurality of cylindrical containers of claim 20, which has at least one finger flap in the dispenser flap adjacent to the tear line connecting the top and bottom tear lines together in said side panel to facilitate tearing the dispenser flap open.

22. The carton loaded with a plurality of cylindrical containers of claim 21, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

23. The carton loaded with a plurality of cylindrical containers of claim 10, said carton having a dispenser flap which when removed provides an opening which permits the removal of the containers from each layer, said dispenser flap formed by a bottom tear line in a location in the side panel which is closest to the other end of the carton, said bottom tear line being at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

24. A carton with two ends for carrying a plurality of cylindrical containers in two layers with at least two rows of containers in each layer comprising;

(a) said carton having a bottom panel, top panel and foldably attached adjoining side panels with at least one end being an interlocking end which is closed by a top end flap foldably attached to the top panel, a bottom end flap foldably attached to the bottom panel and a side end flap which is foldably attached to each side panel, with each side end flap having an end remote from the side panel to which side end flap is attached, with each side end flap having a recessed section in said remote end in which a punch lock with two shoulders and a swing lock are located, with each lock attached to the side end flap by a fold line at least substantially parallel to the fold line by which the side end flap is attached to the side panel, said swing lock being located between the punch lock and the top panel of the carton, said swing lock having a secondary male lock attached by a fold line that is at least substantially perpendicular to the fold line by which the swing lock is attached to the side end flap, said secondary male lock being located adjacent a shoulder of the punch lock, with said end flaps being held together by securing means;

(b) an interlocking separator pad with two ends, of which at least one end is an interlocking end which is located adjacent an interlocking end of the carton, said pad being designed to be located between the two layers of containers with each interlocking end of the pad having a foldably attached leading flap which extends towards the bottom panel of the carton, said pad having two female openings adjacent the interlocking end, with each opening having at least one locking edge, said leading flap having two female openings, with each opening having two locking edge;

(c) with a punch lock on each side end flap projecting through a female opening in the leading flap of the pad with each shoulder on the punch lock being engaged with a locking edge on said opening, with each secondary male lock projecting through a female opening in the pad and engaging a locking edge of the female opening, thereby interlocking the pad to the side end flaps on the interlocking end of the carton; and (d) means for securing the other end of the carton.

25. The carton of claim 24, in which the means for securing the interlocking end of the carton is by gluing the top end flap and bottom end flap to the side end flaps, and the other end of the carton is closed by a top end flap foldably attached to the top panel and a bottom end flap foldably attached to the bottom panel and a side end flap foldably attached to each side panel, with the other end of the carton being closed by gluing the top end flap and bottom end flap to the side end flaps.

26. The carton of claim 25, in which each side end flap on the other end of the carton has an end remote from the side panel to which said side end flap is attached, with each side end flap having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between the secondary male lock and the top panel of the carton, with said separator pad having two female openings adjacent to the other end of the pad, with each female opening having at least one locking edge with each secondary male lock projecting through a female opening in the other end of the pad and engaging a locking edge of the female opening, thereby strengthening the interlocking of the pad to the carton.

27. The carton of claim 26, in which each secondary male lock on each side end flap on each end of the carton has a slot adjacent the fold line by which the secondary male lock is attached to the swing lock which engages the locking edge of a female opening closest to an end of the separator pad.

28. The carton of claim 27, said carton having a dispenser flap which when removed permits the removal of containers from each layer, said dispenser flap formed by a bottom tear line in a side panel which is closest to the other end of the carton, said bottom tear line being at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

29. A container carrying carton with two ends loaded with a plurality of cylindrical containers comprising:

(a) said carton having a bottom panel, top panel and foldably attached adjoining side panels with one end being an interlocking end which is closed by a top end flap foldably attached to the top panel, a bottom end flap foldably attached to the bottom panel and a side end flap which is foldably attached to each side panel, with each side end flap having an end remote from the side panel to which side end flap is attached, with each side end flap having a recessed section in said remote end in which a punch lock with two shoulders and a swing lock are located, with each lock attached to the side end flap by a fold line at least substantially parallel to the fold line by which the side end flap is attached to the side panel, said swing lock being located between the punch lock and the top panel of the carton, said swing lock having a secondary male lock attached by a fold line that is at least substantially perpendicular to the fold line by which the swing lock is attached to the side end flap, said secondary male lock being located adjacent a shoulder of the punch lock, with said end flaps being held together by glue;

(b) two layers of cylindrical containers with three rows of containers in each layer;

(c) an interlocking separator pad with two ends of which one end is an interlocking end which is located adjacent the interlocking end of the carton, said pad being located between the two layers of containers with the interlocking end of the pad having a foldably attached leading flap which extends toward a panel of the carton other than a side panel, said pad having two female openings adjacent the interlocking end, with each opening having a locking edge, said leading flap having two female openings, with each opening in the leading flap having two locking edges;

(d) with a punch lock on each side end flap projecting through a female opening in the leading flap of the pad with each shoulder on the punch lock being engaged with a locking edge on said opening, with each secondary male lock projecting through a female opening in the pad with each secondary male lock engaging a locking edge of the female opening, thereby interlocking the pad to the side end flaps on the interlocking end of the carton; and (e) in which the other end of the carton is closed by a top end flap foldably attached to the top panel, a bottom end flap foldably attached to the bottom panel and a side end flap foldably attached to each side panel, with each side end flap having an end remote from the side panel to which said side end flap is attached, with each side end flap having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between the top panel of the carton and the secondary male lock, with said separator pad having two female openings adjacent to the other end of the pad, with each female opening having a locking edge with each secondary male lock projecting through a female opening in the other end of the pad and engaging a locking edge of the female opening, thereby strengthening the interlocking of the pad to the carton, said other end of the carton being secured by gluing the top end flap and bottom end flap to the side end flaps.

30. The carton loaded with a plurality of cylindrical containers of claim 29, in which each secondary male lock on each side end flap on each end of the carton has a slot adjacent the fold line by which the secondary male lock is attached to the swing lock which engages the locking edge of a female opening closest to an end of the separator pad.

31. The carton loaded with a plurality of cylindrical containers of claim 30, said carton having a dispenser flap which when removed permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

32. The carton loaded with a plurality of cylindrical containers of claim 31, in which a female opening on the interlocking end of the separator pad and the female opening on the other end of the pad and a female opening in the leading flap are located between the first and second rows of containers and the other female opening on the interlocking end of the separator pad and on the other end of the pad and the other female opening in the leading flap are located between the second and third rows of containers.

33. A carton for carrying a plurality of cylindrical containers in two layers with three rows of containers in each layer comprising:

(a) said carton having a bottom panel, top panel and foldably attached adjoining side panels with one end being an interlocking end which is closed by a top end flap foldably attached to the top panel, a bottom end flap foldably attached to the bottom panel and a side end flap which is foldably attached to each side panel, with each side end flap having an end remote from the side panel to which side end flap is attached, with each side end flap having a recessed section in said remote end in which a punch lock with two shoulders and a swing lock are located, with each lock attached to the side end flap by a fold line at least substantially parallel to the fold line by which the side end flap is attached to the side panel, said swing lock being located between the punch lock and the top panel of the carton, said swing lock having a secondary male lock attached by a fold line that is at least substantially perpendicular to the fold line by which the swing lock is attached to the side end flap, said secondary male lock being located adjacent a shoulder of the punch lock, with said end flaps being held together by glue;

(b) an interlocking separator pad with two ends, of which one end is an interlocking end which is located adjacent the interlocking end of the carton, said pad being designed to be located between the two layers of containers with the interlocking end of the pad having a foldably attached leading flap which extends towards a panel of the carton other than a side panel, said pad having two female openings adjacent the interlocking end with each opening having a locking edge, said leading flap having two female openings, with each opening in the leading flap having at two locking edges;

(c) with a punch lock on each side end flap on the interlocking end of the carton projecting through a female opening in the leading flap of the pad with each shoulder on the punch lock being engaged with a locking edge on said opening, with each secondary male lock projecting through a female opening in the pad and engaging a locking edge of the female opening, thereby interlocking the pad to the side end flaps on the interlocking end of the carton; and (d) in which the other end of the carton is closed by a top end flap foldably attached to the top panel, a bottom end flap foldably attached to the bottom panel and a side end flap is foldably attached to each side panel, with each side end flap having an end remote from the side panel to which said side end flap is attached, with each side end flap having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between secondary male lock and the top panel of the carton, with said separator pad having two female openings adjacent to the other end of the pad, with each female opening having a locking edge with each secondary male lock projecting through a female opening in the other end of the pad and engaging a locking edge of the female opening, thereby strengthening the interlocking of the pad to the carton, said other end of the carton being secured by gluing the top end flap and bottom end flap to the side end flaps.

34. The carton of claim 33, in which each secondary male lock on each side end flap on each end of the carton has a slot adjacent the fold line by which the secondary male lock is attached to the swing lock which engages the locking edge of a female opening closest to an end of the separator pad.

35. The carton of claim 34, said carton having a dispenser flap which when removed permits the removal of any containers in each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

36. A blank for a carton with two ends for carrying a plurality of cylindrical containers in two layers with at least two rows in each layer and an interlocking separator pad for keeping the layers of containers separated comprising:

(a) said carton blank having a bottom panel, top panel and foldably attached adjoining side panel, with one end of the carton being an interlocking end, with each end of the carton being designed to be closed by a top end flap foldably attached to the top panel, a bottom end flap foldably attached to the bottom panel and a side end flap which is foldably attached to each side panel, with each side end flap on the interlocking end of the carton having an end remote from the side panel to which side end flap is attached, with each side end flap having a recessed section in said remote end in which a punch lock with two shoulders and a swing lock are located, with each lock attached to the side end flap by a fold line at least substantially parallel to the fold line by which the side end flap is attached to the side panel, said swing lock being located between the punch lock and the top panel of the carton, said swing lock having a secondary male lock attached by a fold line that is at least substantially perpendicular to the fold line by which the swing lock is attached to the side end flap, said secondary male lock being located adjacent a shoulder of the punch lock;

(b) an interlocking separator pad with two ends, of which one end is an interlocking end, said pad being designed to be located between the two layers of containers with the interlocking end of the pad having a foldably attached leading flap which extends towards a panel of the carton other than a side panel, said pad having two female openings adjacent the interlocking end, each with a locking edge, said leading flap having two female openings, with each opening leading flap having two locking edges; and (c) with a punch lock on each side end flap on the interlocking end of the carton which is designed to project through a female opening in the leading flap of the pad with each shoulder on the punch lock being engaged with a locking edge on said opening, with each secondary male lock which is designed to project through a female opening in the pad and engaging a locking edge of the female opening, thereby interlocking the pad to the side end flaps on the interlocking end of the carton.

37. The blank for a carton and separator pad of claim 36, in which each side end flap on the other end of the carton has an end remote from the side panel to which said side end flap is attached, with each side end having a recessed section in said remote end in which a swing lock is attached to the side end flap by a fold line at least substantially parallel to the fold line by which the side end flap is attached to the side panel, said swing lock having a secondary male lock attached by a fold line that is at least substantially perpendicular to the fold line by which the swing lock is attached to the side end flap, with said swing lock being located between the top panel of the carton and the secondary male lock, with said separator pad having two female openings adjacent the other end of the pad with each female opening having a locking edge with each secondary male lock being designed to project through a female opening in the other end of the pad and engaging a locking edge of the female opening.

38. The blank for a carton and separator pad of claim 37, in which said carton has a dispenser flap which when removed permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

* * * * *